US006476822B1

(12) United States Patent
Burbank

(10) Patent No.: US 6,476,822 B1
(45) Date of Patent: Nov. 5, 2002

(54) METHOD AND APPARATUS FOR DISPLAYING IMAGES

(75) Inventor: Niles S. Burbank, Anrora (CA)

(73) Assignee: ATI International Srl, Barbados (KN)

( * ) Notice: Subject to any disclaimer, the term of this patent is extended or adjusted under 35 U.S.C. 154(b) by 0 days.

(21) Appl. No.: 09/385,828

(22) Filed: Aug. 30, 1999

(51) Int. Cl.[7] ..... G09G 5/14
(52) U.S. Cl. ..... 345/634
(58) Field of Search ..... 345/113–115, 629, 345/634–637

(56) References Cited

U.S. PATENT DOCUMENTS 5,065,346 A * 11/1991 Kawai et al.
5,621,429 A * 4/1997 Yamaashi et al.
5,838,334 A * 11/1998 Dye
5,844,545 A * 12/1998 Suzuki et al.

* cited by examiner

*Primary Examiner*—Jeffery Brier
(74) *Attorney, Agent, or Firm*—Vedder, Price, Kaufman & Kammholz

(57) ABSTRACT

In accordance with a specific embodiment of the present invention, an application for providing static images requests an overlay window. Examples of such static images include JPEG, GIF, TIFF, and bitmapped images. The overlay request is granted by system drivers. Once the overlay window has been provided an enhanced static image is provided to the image driver from a still image application. The image driver will store the static image in the overlay memory area whereby it is displayed in an enhanced mode upon the display device.

20 Claims, 6 Drawing Sheets

METHOD AND APPARATUS FOR DISPLAYING IMAGES

FIELD OF THE INVENTION

The present invention relates generally to a system and method for providing an image to a display device, and more specifically to a system and method for providing an enhanced image to a display device.

BACKGROUND OF THE INVENTION

Early personal computers were capable of displaying images in a mono-chromatic mode. The use of black and white monitors was adequate for displaying the textual information, and basic graphical information associated with early personal computers. By supporting only black and white images, early personal computers were able to efficiently utilize scarce memory. Efficient memory use was the result of black and white images requiring only a single pixel per bit. When an image was stored as a bit map only a single bit was needed to store one pixel of data.

As systems and applications became more sophisticated it became desirable to display pixel information in color. In order to store color information additional bits of memory were needed for each pixel. The number of pixels used to represent a specific color for a pixel is referred to as color depth.

The color depth of a modern personal computer system is defined to a default, or predetermined value during system start up. Common default color depth values include 8 and 16 bits of data per pixel. An 8 bit color depth accommodates 256 colors, while a 16 bit color depth accommodates 65,536 colors.

Eight or 16 bits of color depth is generally adequate for most applications. However, 24/32 bits of color are needed where high quality/true color images are desirable. A color depth of 24 bits provides a range of over 16.7 million colors. Generally, only 24 bits of data are actually used to produce true color images, however, because 24 bits of color data are often stored in a 32 word to accommodate memory partitioning, it is also sometimes referred to as a 32 color depth. Applications that display still pictures operate at the default color depth of the system. Therefore, when a default value of 8 or 16 bits is chosen still graphics, such as photographs, capable of being displayed in true color will be displayed at the lower color depth resolution.

In order to display still images in true 24 bit color, it is necessary to switch from 8 or 16 bit color depth to the full color 24 bit color depth by changing preferences and restarting the system. Upon resuming normal operation after reset, applications accessing the video memory could supply the full 24 bit pixel information to the video system.

Setting the color depth of a system requires that the entire display device support the required color depth. This is requires excess memory to be dedicated to portions of the display device that would operate adequately with only an 8 or 16 bit color mode. For example, word processing and many internet applications generally appear adequate using an 8 or 16 bit color depth. Prior methods, however, require the entire video memory space to be at an enhanced 24/32 operating mode even where less color depth is appropriate.

One prior art solution that addresses the situation where only a portion of a display needs to display enhanced colors is the use of overlay schemes. Overlay schemes have been used to display video, which requires greater than 16 bit color depth, to be displayed in a specified area of a display device while the remainder of the system remains at the default 8 or 16 bit color depth.

Overlays are supported by using a color key value stored at a specified location in the default image memory to indicate when it is desirable for a specified location of the display device to display a video image having a 24/32 color depth. For example, where color key value is 45, an 8 bit pixel location of the video map containing the value 45 indicates that an alternate location of memory will be accessed to provide a full 24 bit pixel value to the video image. While the use of overlay windows has been confined to use with video images, the applications utilizing an overlay window have not been used to access still images. Therefore, a system and method capable of implementing and/or utilizing the enhanced image drivers for non-dynamic images would be beneficial.

DETAILED DESCRIPTION OF THE DRAWINGS

In accordance with a specific embodiment of the present invention, an application for providing static images requests an overlay window. Examples of such static images include JPEG, GIF, TIFF, and bitmapped images. Once the overlay window has been provided, an enhanced static image is provided to the image driver. The image driver will store the static image in the overlay memory area whereby it is displayed in an enhanced mode upon the display device.

Figure 1:
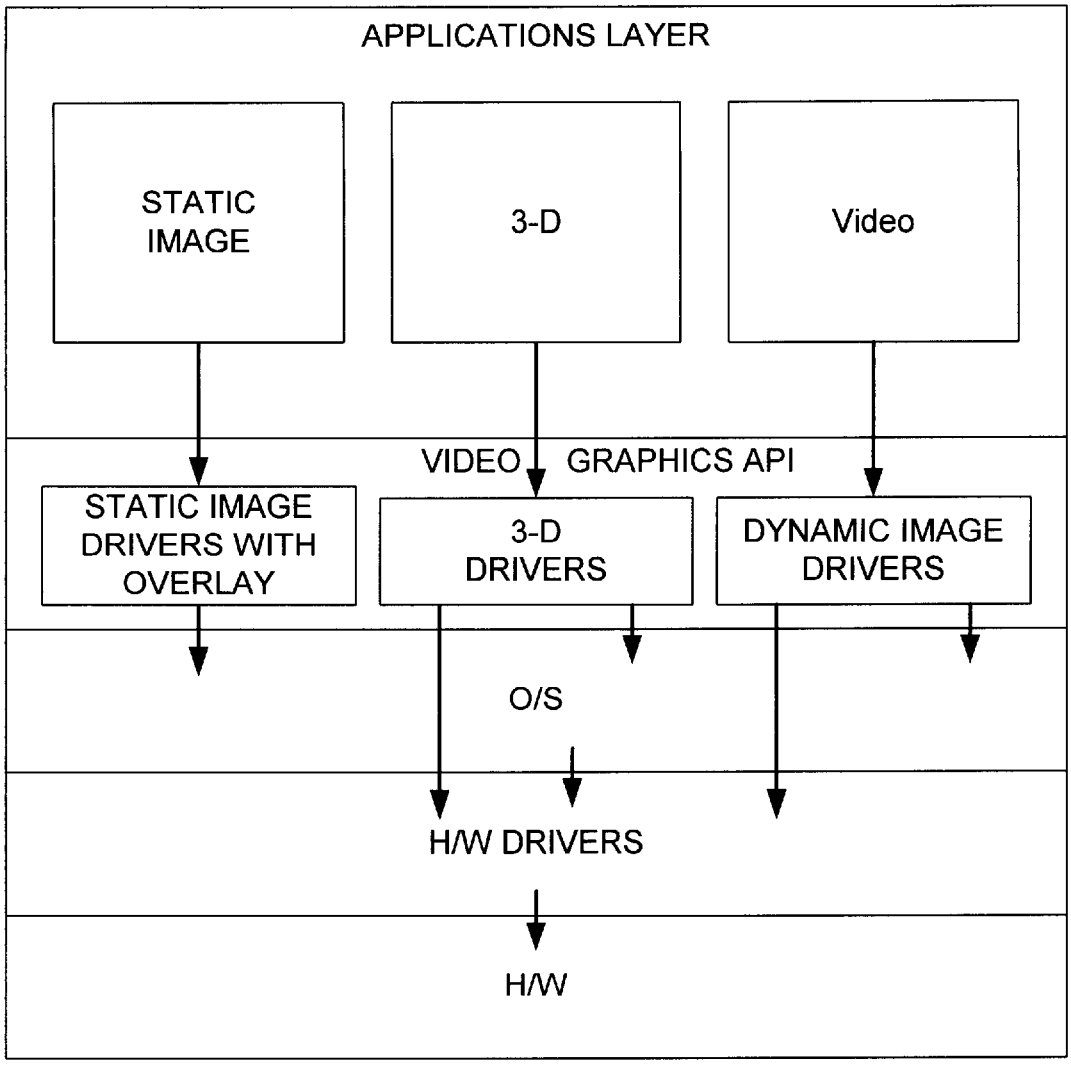
FIGS. 1 and 2 illustrate, in block form, a representation of a system hardware/software hierarchy in accordance with the present invention.

The present invention is best understood with reference to the figures. FIG. 1 represents a simplified layout of the hardware and software architectural layers associated with a computer system in accordance with the present invention. The architectural layers include a hardware layer which includes the central processing unit of a computer system, as well as any customized hardware added to the system, including display drivers and other video graphic devices.

At the layer above the hardware layer are the hardware drivers which actually call, or access, the hardware layer devices. Generally, hardware drivers are provided by the hardware manufacturers. For example, a graphics card manufacturer will generally supply specific drivers to access a specific graphics card which they make.

The next layer of FIG. 1 represents the operating system of the computer. Examples of operating systems include Unix, Apple Computer's OS8, and Microsoft's Windows 98 operating systems. The OS layer generally interfaces to the hardware drivers.

Above the OS layer is a video interface layer labeled Video Graphics API. In one embodiment, the video graphics API (Application Programming Interface) specifies a protocol that the application layer, residing above the video API, may use to access the lower hardware and O/S layers without having first hand knowledge of these layers. Examples of drivers associated with the video graphics API would include static image drivers, 3D drivers, and dynamic image drivers. In another embodiment, the layer labeled VIDEO GRAPHICS API can be made up of several distinct APIs, each exposing a particular class of features to the applications. For example, 3D capabilities, video capabilities, and basic drawing capabilities.

A static image driver generally includes a tool set including specific driver groups such as the GDI (graphical device interface) protocol supported by MICROSOFT. Prior art static image drivers of this type support only those tasks associated with static images. Examples of such applications accessing such drivers in the prior art include text manipulation applications, graphical data, and communications applications can provide static images by calling the static video driver library. The color depth at which the static image driver operates is dependant upon the default value upon startup. As previously discussed, the default value can be changed depending upon the system requirements between normal 8 or 16 bit color modes and enhanced 24/32 color modes.

Applications displaying still images, such as photographic images, and graphics, access the static image drivers in order to obtain support to the hardware layer and ultimately to the display device. As a result, it is necessary to change the default value and restart the system in order to obtain an enhanced video image using the static image drivers.

By providing overlay support within the static image drivers, it is possible for the static image application to request an overlay window in order to provide an enhanced display of the static image. In order to display a 24/32 color depth image, the static image application will first indicate to the static image driver that an overlay window is needed. Subsequently the static image application will provide the 24/32 image information to the static driver for display using the overlay window. This is an advantage over the prior art, in that it is not necessary to reset the entire system in order to display still color images.

Figure 2:
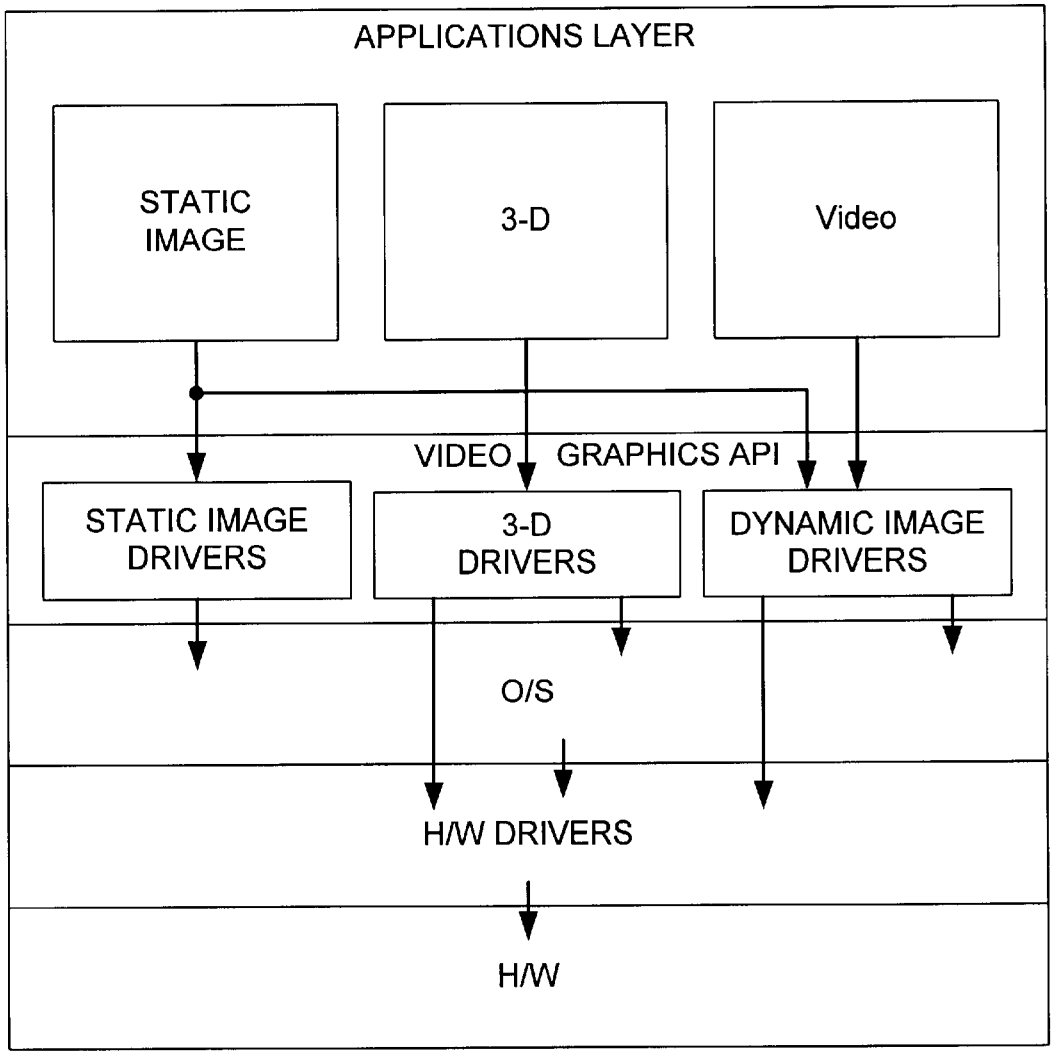

A static image application in FIG. 1 is labeled STATIC IMAGE. A dynamic image application in FIG. 1 is labeled VIDEO. Dynamic image applications generally provide overlay requests to dynamic image drivers, and subsequently provide enhanced video data to these dynamic drivers. FIG. 2 illustrates the hierarchical layers of FIG. 1 in an embodiment whereby the STATIC IMAGE application accesses the dynamic image drivers. By accessing the dynamic image drivers directly, overlay support from the dynamic image drivers can be obtained, thereby reducing the need to have the overlay support specifically within the STATIC IMAGE DRIVERS. It should be noted that the various image drivers can be grouped into categories and associated with specific drive elements. For example, the DirectDraw library from Microsoft will generally be analogous to the DYNAMIC IMAGE DRIVERS of FIGS. 1 and 2, while GDI drivers from Microsoft will generally be analogous to the static image driver.

Figure 3:
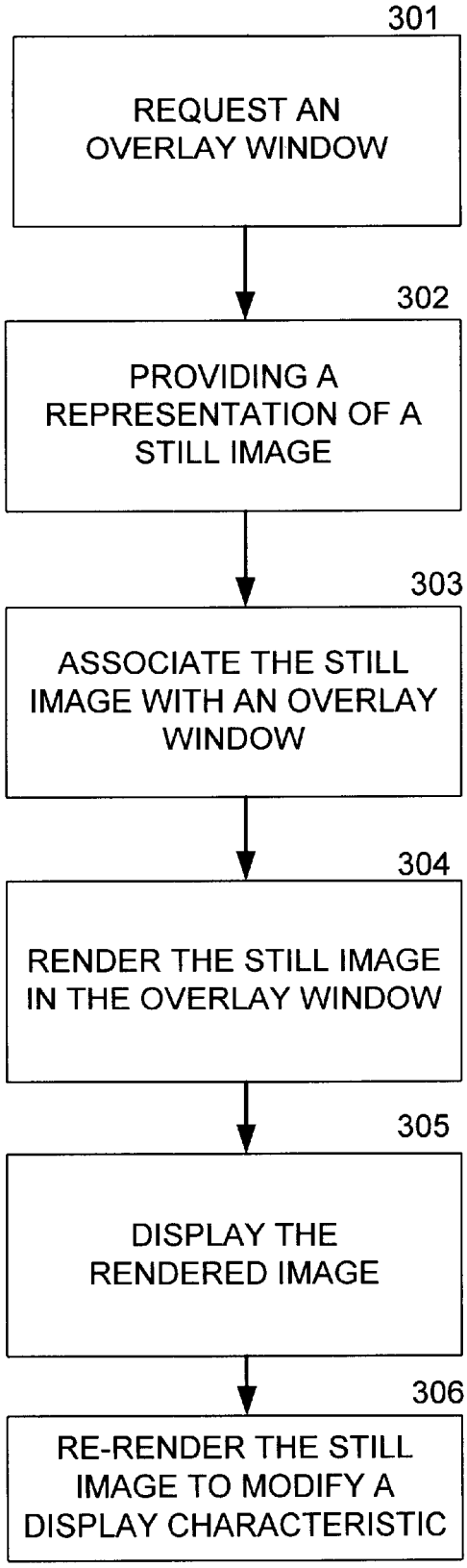
FIGS. 3–5 illustrate, in flow diagram form, methods in accordance with the present invention.

FIG. 3 illustrates, in flow diagram form, a method in accordance with the present invention. At step 301, an application for providing static images makes a request for an overlay window. By requesting an overlay window, it is possible to have a specific portion of a display device have a different color depth than the general display device color depth. As discussed previously, in a traditional manner an enhanced 24/32 bit color mode is provided within the overlay window, while the rest of the system is at a default 8 or 16 bit color depth. It should be noted that the data being presented by the overlay window may actually have a color depth less than the remainder of the display. Generally this makes no sense, however, in that the image is capable of being displayed by the data contained within the display and any additional memory offered by the overlay would not be utilized.

At step 302 a representation of a still image is provided. Referring to FIG. 1, after the static image application has notified the static image driver that an overlay window is desired, the image is transmitted. Generally the still image is transmitted in a binary form and received by the drivers for further processing.

At step 303 the still image is associated with the overlay window. Once the static image application has requested the window the subsequent transmitted data is associated by the static image driver to the appropriate overlay window.

At step 304 the still image is rendered to the overlay window. The step of rendering generally will occur to the video memory, whereby each pixel will generally be represented by a plurality of bits.

At step 305 the rendered image is displayed upon a display device.

At step 306 the still image is re-rendered in order to modify a display characteristic. The step 306 takes advantage of the functions generally associated with overlay windows, which include gamma correction, contrast, brightness, and color correction. This is an advantage over the prior art, in that the still image can be modified in manners previously supported only for dynamic images, such as video.

A still image is exclusive of dynamic images, or portions of dynamic images. For example, a single frame of a video transmission would not be considered to be a still image for purposes described herein. Examples of still imaged protocols include JPEG images, GIF images, TIFF images, and bit map images. In addition, it is understood that variations based upon these protocols will also be considered still images.

Figure 4:
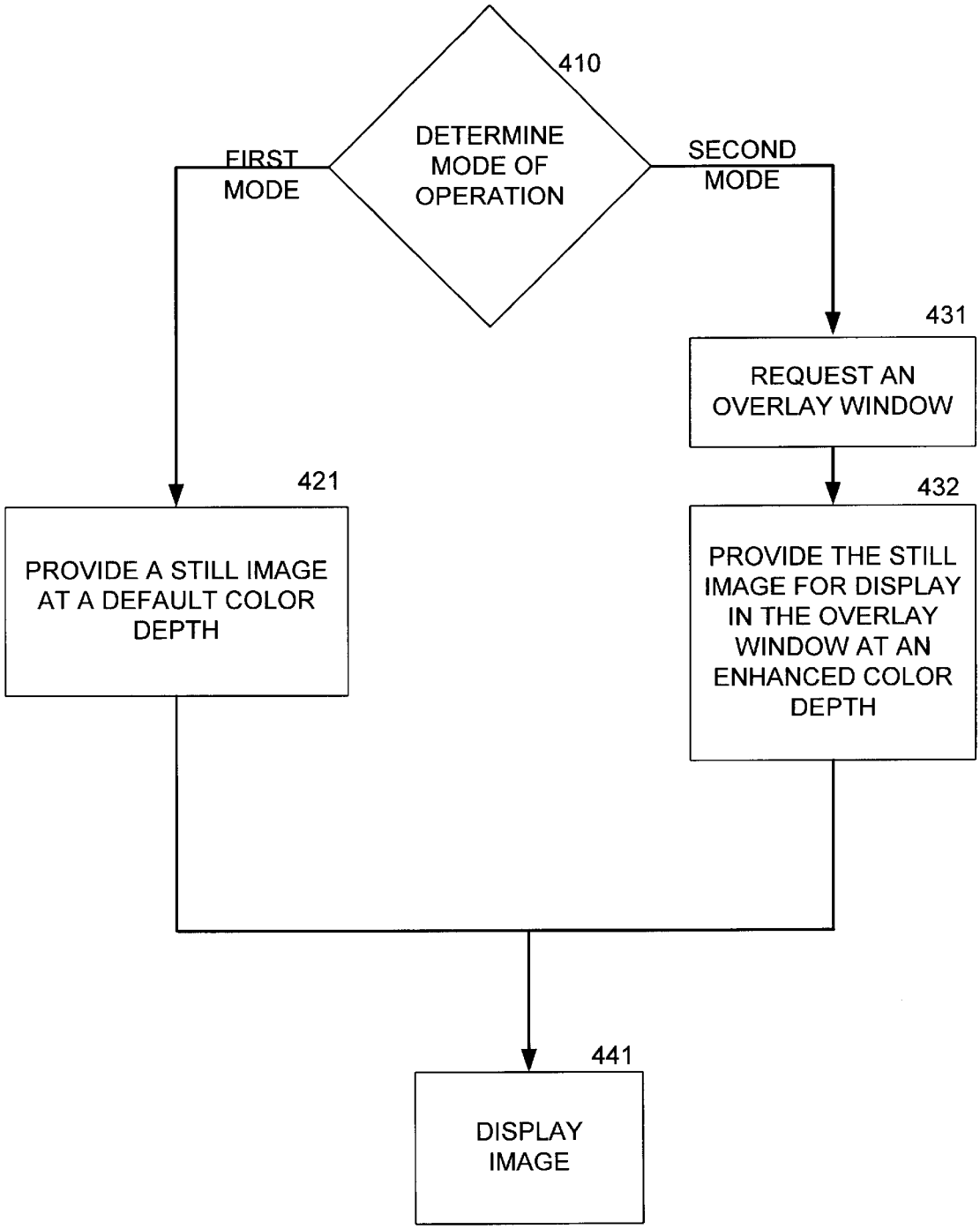

FIG. 4 illustrates a method, in flow diagram form, in accordance with the present invention. At step 410, a determination is made whether or not a system is operating in a first or a second mode. When operating in a first mode the flow proceeds to step 421, whereby a still image is provided at a default color depth. Next, flow proceeds at step 441 where the image is displayed.

However, if it is determined at step 410 that the system is operating in a second mode, the flow proceeds to step 431. At step 431, the still image application will make a request for an overlay window in the manner previously discussed. At step 432, following the overlay window being granted, the still image application will provide the still image for display in the overlay window. By displaying the image within the overlay window, the application receives enhanced color depth support without having to restart the system. Next, the flow proceeds to step 441 whereby the enhanced image is displayed on the display device.

It will be understood by one skilled in the art, that the display driver which takes information from the video memory and provides it to the display device will have inherent knowledge as to the actual color key such that the display device driver will retrieve image information having an enhanced color depth from a different location when a pixel having the color key value is accessed. In this manner appropriately enhanced images are displayed upon a display device.

Figure 5:
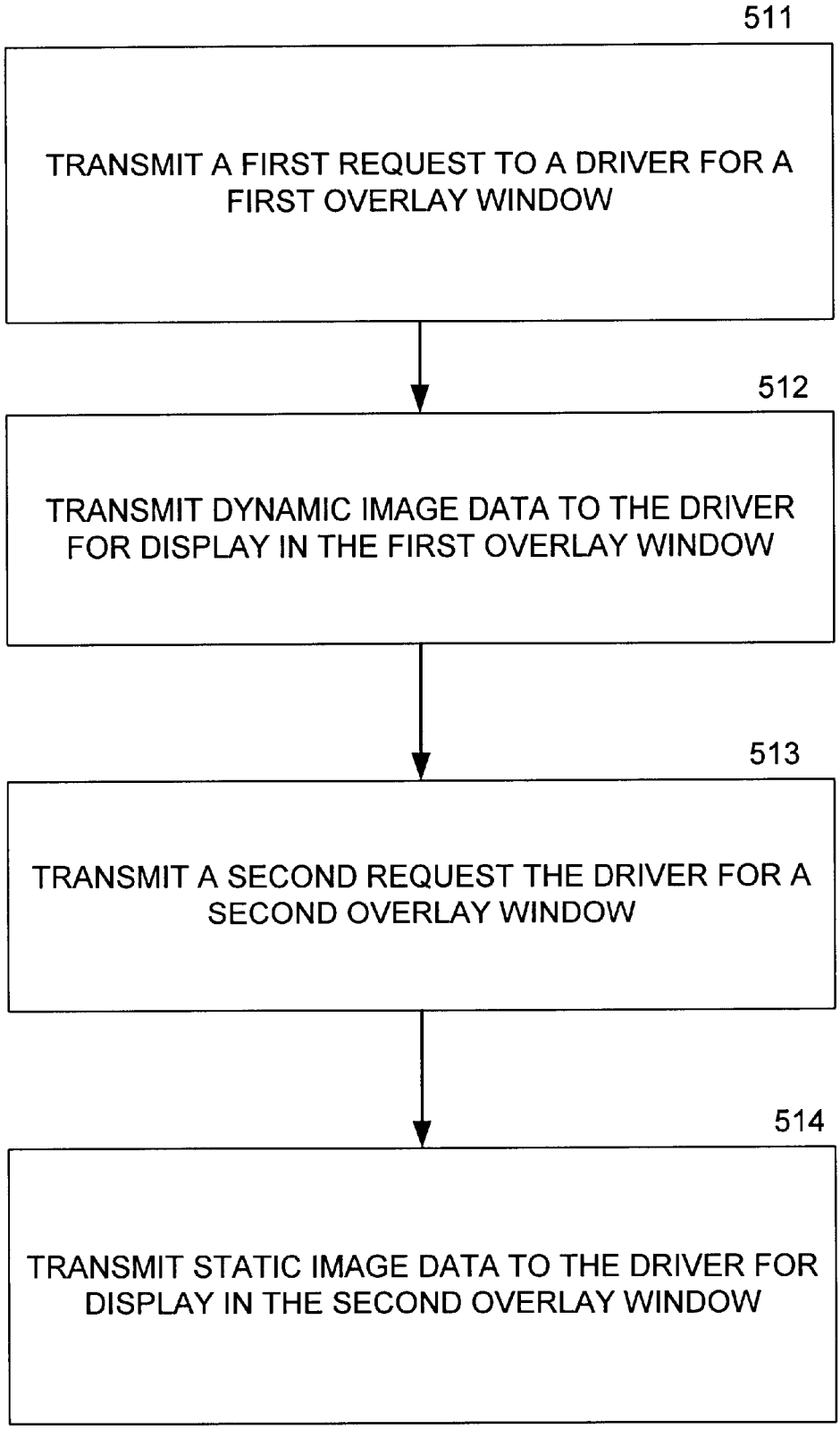

FIG. 5 illustrates, in flow diagram form, a method in accordance with the present invention. At step 511 a first request for a first overlay window is transmitted. At step 512, dynamic image data is transmitted to the driver for display within the first overlay window. The transmission of the dynamic image data is analogous to providing video data to the first overlay window for display. At step 513, a second request to the display driver is provided for a second overlay window. At step 514, a static image data is provided to the driver in order to display the transmitted static image in the second overlay window.

The method of FIG. 5 illustrates a single driver handling both dynamic image data and static image data from varying applications. In this manner, it is possible to display static image data without restarting the system and without duplicating drivers capable of providing overlay windows. In this manner, an advantage using common drivers for both static and dynamic images is realized over the prior art.

It should be understood that the specific steps indicated in the methods herein may be implemented in hardware and/or software. For example, a specific step may be performed using software and/or firmware executed on one or more processing modules. In general, a system for providing images may include a more generic processing module and memory. The processing module can be a single processing device or a plurality of processing devices. Such a processing device may be a microprocessor, microcontroller, digital processor, micro computer, a portion of the central processing unit, a state machine, logic circuitry, and/or any device that manipulates the signal. The manipulation of these signals is generally based upon operational instructions. The memory may be a single memory device or a plurality of memory devices. Such a memory device may be a read only memory, a random access memory, a floppy disk memory, magnetic tape memory, erasable memory, a portion of a system memory, and/or any device that stores operational instructions in a digital format. Note that when the processing module implements one or more of its functions to be a state machine or logic circuitry, the memory storing in the corresponding operational instructions is embedded within the circuitry comprising the state machine and/or other logic circuitry.

Figure 6:
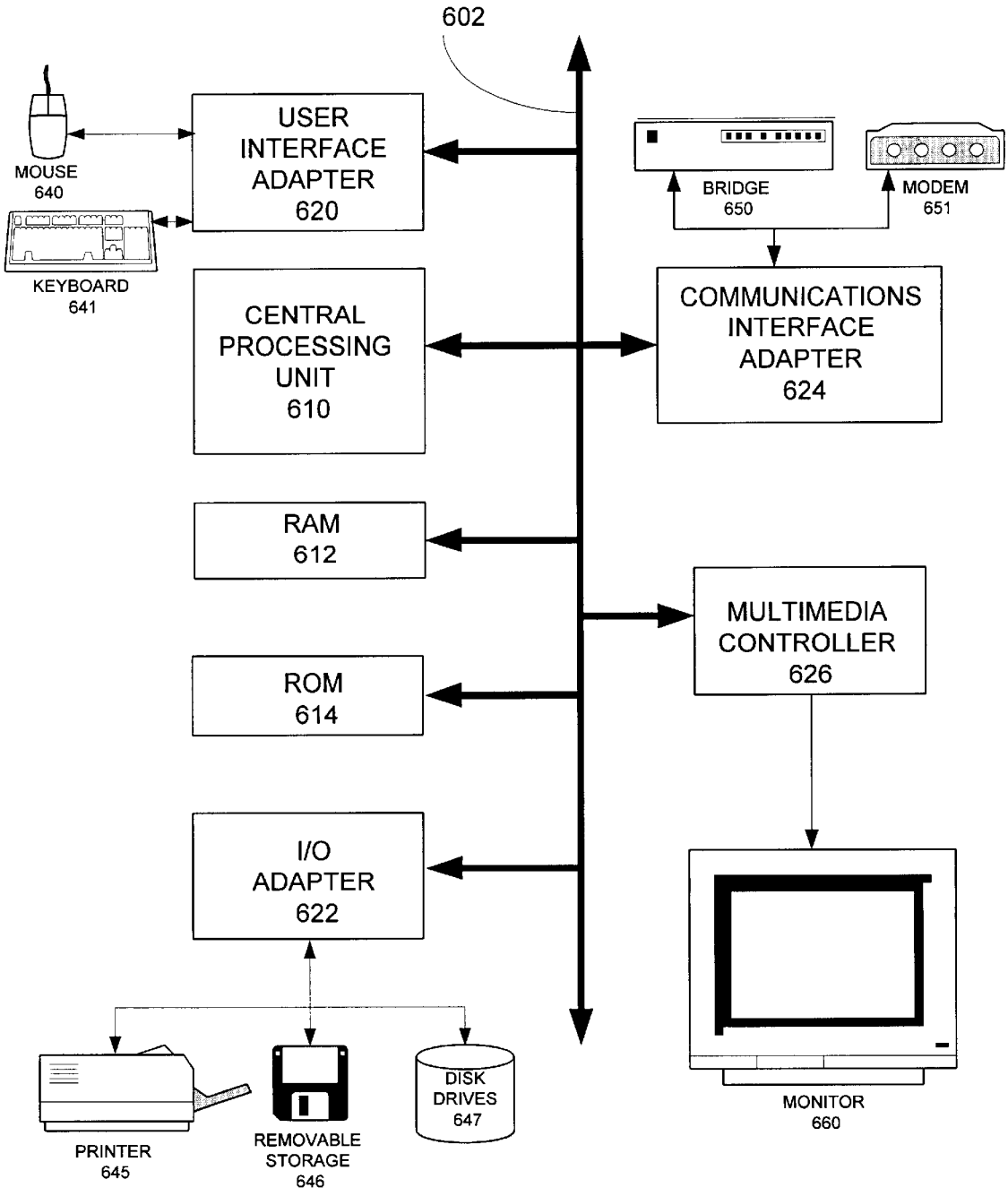
FIG. 6 illustrates, in block diagram form, a computer system in accordance with the present invention.

FIG. 6 illustrates, in block diagram form, a processing device in the form of a personal computer system 600. The computer system 600 is illustrated to include a central processing unit 610, which may be a conventional proprietary data processor, memory including random access memory 612, read only memory 614, and input output adapter 622, a user interface adapter 620, a communications interface adapter 624, and a multimedia controller 626.

The input output (I/O) adapter 626 is further connected to, and controls, disk drives 647, printer 645, removable storage devices 646, as well as other standard and proprietary I/O devices.

The user interface adapter 620 can be considered to be a specialized I/O adapter. The adapter 620 is illustrated to be connected to a mouse 640, and a keyboard 641. In addition, the user interface adapter 620 may be connected to other devices capable of providing various types of user control, such as touch screen devices.

The communications interface adapter 624 is connected to a bridge 650 such as is associated with a local or a wide area network, and a modem 651. By connecting the system bus 602 to various communication devices, external access to information can be obtained.

The multimedia controller 626 will generally include a video graphics controller capable of displaying images upon the monitor 660, as well as providing audio to external components (not illustrated).

Generally, the system 600 will be capable of implementing the system and methods described herein.

It should now be apparent that the present invention provides an advantage over the prior art, in that static images are capable of being displayed without having to define an enhanced default color depth and restarting a system. Such a method as put forth herein allows for reuse of existing code and enhances the functional operations available and used by corresponding applications. Furthermore, one skilled in the art will recognize that many specific implementations to the present invention can be implemented. For example, the class of images which utilizes 24/32 bits of color to represent at high quality includes images may be encoded in a different color space, particularly the YUV color space, where the images use fewer than 24 bits per pixel.

I claim:

1. A method for displaying an image on a computer display device, the method comprising:

providing a representation of a still image;

associating the still image with an overlay window; and rendering the still image in the overlay window;

wherein an overlay color depth of the still image is greater than a default color depth of the computer display.

2. The method of claim 1, wherein the still image is not associated with a dynamic content image.

3. The method of claim 1, wherein the still image is a JPEG-based image.

4. The method of claim 1, wherein the still image is a GIF-based image.

5. The method of claim 1, wherein the still image is a TIFF-based image.

6. The method of claim 1, wherein the still image is a bitmap-based image.

7. The method of claim 1 further comprising the step of:

re-rendering the still image to modify a display characteristic of the still image.

8. The method of claim 7, wherein the display characteristic is gamma correction.

9. The method of claim 7, wherein the display characteristic is contrast.

10. The method of claim 7, wherein the display characteristic is brightness.

11. The method of claim 7, wherein the display characteristic is color.

12. A method for providing a representation of an image, the method comprising:

requesting an overlay window;

providing a still image to be displayed as part of the overlay window; and displaying the still image in the overlay window at a greater color depth than a default color depth.

13. The method of claim 12, wherein the request is made to a dynamic image driver.

14. The method of claim 12, wherein the default color depths is one of 8 and 16 bits per pixel, and the different color depth is one of 24 and 32 s per pixel.

15. A method for providing an image in a system having a default color depth, the method comprising the steps of:

in a first mode of operation:

providing a still image at the default color depth; and in a second mode of operation:

requesting an overlay window; and providing the still image for display in the overlay window at an enhanced color depth.

16. The method of claim 15, wherein the steps of providing in the first and second mode of operation provide the still image to a common image driver.

17. The method of claim 15, wherein the steps of providing in the first and second mode of operation provide the still image to different image drivers.

18. A method of providing an image, the method comprising the following steps:

transmitting a first request to a driver for a first overlay window;

transmitting dynamic image data to the driver for display in the first overlay window;

transmitting a second request to the driver for a second overlay window;

transmitting static image data to the driver for display in the second overlay window; and wherein the color depth of at least one of the first overlay window and the second overlay window is greater than a default color depth of a computer display.

19. A system for providing an image, the system comprising:

a processing module; and memory operably coupled to the processing module, wherein the memory stores operational instructions that cause the processing module to:

provide a representation of a still image;

associate the still image with an overlay window;

render the still image in the overlay window; and wherein an overlay color depth of the still image is greater than a default color depth of a computer display.

20. A computer readable storage medium for providing an image comprising the steps of:

providing a representation of a still image;

associating the still image with an overlay window;

rendering the still image in the overlay window; and wherein an overlay color depth of the still image is greater than a default color depth of a computer display.

* * * * *